US005460887A

United States Patent [19]

Pechhold

[11] Patent Number: 5,460,887

[45] Date of Patent: Oct. 24, 1995

[54] STAIN-RESISTANT POLYAMIDE SUBSTRATES

[75] Inventor: Engelbert Pechhold, Chadds Ford, Pa.

[73] Assignee: E. I. Du Pont de Nemours and Company, Wilmington, Del.

[21] Appl. No.: 368,924

[22] Filed: Jan. 5, 1995

Related U.S. Application Data

[63] Continuation-in-part of Ser. No. 220,896, Mar. 31, 1994, abandoned, which is a continuation-in-part of Ser. No. 857,178, Mar. 25, 1992, abandoned, which is a continuation-in-part of Ser. No. 809,843, Dec. 18, 1991, abandoned, which is a continuation-in-part of Ser. No. 626,885, Dec. 13, 1990, abandoned.

[51] Int. Cl.[6] ..... B32B 27/34

[52] U.S. Cl. ..... 428/395; 428/97; 428/378; 428/364

[58] Field of Search ..... 428/96, 375, 378, 428/395, 364; 528/90, 99, 107, 143, 150; 524/437; 8/115.6, 535

[56] References Cited

U.S. PATENT DOCUMENTS

| | | | |
|---|---|---|---|
| Re. 33,365 | 10/1990 | Blyth et al. | 428/97 |
| 4,680,212 | 7/1987 | Blyth et al. | 428/395 |
| 4,822,373 | 4/1989 | Olson et al. | 8/115.6 |
| 4,839,212 | 6/1989 | Blyth et al. | 428/395 |
| 4,879,180 | 11/1989 | Blyth et al. | 428/395 |
| 4,883,839 | 11/1989 | Fitzgerald et al. | 525/136 |
| 4,925,707 | 5/1990 | Vinod | 427/393.4 |
| 4,948,650 | 8/1990 | Fitzgerald et al. | 428/96 |
| 4,963,409 | 10/1990 | Liss et al. | 428/96 |
| 5,001,004 | 3/1991 | Fitzgerald et al. | 428/263 |
| 5,032,136 | 7/1991 | Fitzgerarald et al. | 8/115.6 |
| 5,057,121 | 10/1991 | Fitzgerald et al. | 8/133 |
| 5,059,420 | 10/1991 | Scholla et al. | 424/405 |
| 5,074,883 | 12/1991 | Wang | 8/115.6 |
| 5,096,747 | 3/1992 | Scholla et al. | 427/299 |
| 5,137,759 | 8/1992 | Vinod | 427/393.4 |
| 5,229,483 | 7/1993 | Fitzgerald | 528/173 |
| 5,346,726 | 9/1994 | Pechhold | 427/393.4 |
| 5,356,689 | 10/1994 | Pechhold | 428/96 |
| 5,358,769 | 10/1994 | Pechhold | 428/96 |

*Primary Examiner*—Patrick J. Ryan
*Assistant Examiner*—J. M. Gray

[57] ABSTRACT

Polyamide substrates treated with stain-resists which comprise blends of maleic anhydride/alpha-olefin polymers and sulfonated phenol-formaldehyde condensation products. Some of the stain-resist blends are water-soluble at low pH, even in the absence of surfactant, and are strongly substantive and more resistant to yellowing than the condensation products.

13 Claims, No Drawings

STAIN-RESISTANT POLYAMIDE SUBSTRATES

CROSS REFERENCE TO RELATED APPLICATIONS

This application is a continuation-in-part of U.S. application Ser. No. 08/220,896 filed Mar. 31, 1994, now abandoned, which is a continuation-in-part of U.S. application Ser. No. 07/857,178 filed Mar. 25, 1992, now abandoned, which is a continuation-in-part of U.S. application Ser. No. 07/809,843 filed Dec. 18, 1991, now abandoned, which is a continuation-in-part of U.S. application Ser. No. 07/626,885 filed Dec. 13, 1990, now abandoned.

FIELD OF THE INVENTION

The present invention relates to polyamide substrates treated with polymeric stain-resist compositions.

BACKGROUND OF THE INVENTION

Polyamide substrates, such as nylon carpeting, upholstery fabric and the like, are subject to staining by a variety of agents, e.g., foods and beverages. An especially troublesome staining agent is FD&C Red Dye No. 40, commonly found in soft drink preparations. Different types of treatments have been proposed to deal with staining problems. One approach is to apply a composition containing a sulfonated phenol-formaldehyde condensation product to the substrate. However, sulfonated phenol-formaldehyde condensation products are themselves subject to discoloration; commonly they turn yellow. Yellowing problems are described by W. H. Hemmpel in a March 19, 1932 article in *America's Textiles*, entitled "Reversible Yellowing Not Finisher's Fault". Hemmpel attributes yellowing to exposure of a phenol-based finish to nitrogen oxides and/or ultraviolet radiation. To deal with the yellowing problem, the condensation products were modified by Liss et al. in U.S. Pat. No. 4,963,409 by acylation or etherification of some of the phenolic hydroxyls. My U.S. application Ser. No. 08/126,149 discloses and claims polyamide fibrous substrates treated with water-soluble or water-dispersible maleic anhydride/alpha-olefin polymers to make them stain resistant and methods for preparing them. The compositions useful in imparting stain-resistance to the substrates of this invention are disclosed and claimed in my copending application Ser. No. 08/171,892.

BRIEF SUMMARY OF THE INVENTION

The present invention provides a composition useful for imparting stain-resistance to a polyamide fibrous substrate comprising (i) a water-soluble or water-dispersible alpha-olefin/maleic anhydride polymer or a mixture of said polymers; and (ii) a sulfonated phenol-formaldehyde condensation product, which is useful as a dye resist agent, a dye fixing agent, a dye reserving agent or an agent which improves the wet-fastness of dyeing on polyamide fibers.

The compositions of the present invention show enhanced durability to shampoo washing of polyamide substrates treated with the compositions. In addition, the stain-resists of this invention are more resistant to yellowing when exposed to UV light or $NO_x$ gases than are the sulfonated phenol/formaldehyde condensates. The invention provides composition capable of imparting good stain-resistance together with a low propensity to yellowing and having good substantive properties. A further problem associated with prior art compositions is that they have low solubility in water at the low pH preferably used to treat textile articles unless surfactant is used. At least some embodiments of the invention provide a stain-resistant composition having a good water-solubility.

DETAILED DESCRIPTION OF THE INVENTION

The Blend

The two components may be blended together in a wide range of relative proportions. For example, the weight ratio of maleic anhydride copolymer to resin may lie in the range of between about 95:5 and 5:95, preferably between about 90:10 and about 10:90, more preferably between about 60:40 and 40:60. The pH of the blend is adjusted to the required pH preferably in the range between 1 and 3 more preferably between 1.5 and 2.5 with acid. Surprisingly some of the stain-resistant compositions of the present invention remain clear at such low pH. This finding is advantageous since the stain-resistant composition of this invention need not contain any surfactant to solubilize the active ingredient. If desired however, the composition may contain a surfactant. Higher pH in the range up to between pH 7 and 9 may be used as well.

The Maleic Anhydride/Alpha-Olefin Polymer

The polymers useful for the purposes of this invention comprise one or more water-soluble or water-dispersible hydrolyzed maleic anhydride polymers. A variety of linear and branched chain alpha-olefins can be used for the purposes of this invention. Particularly useful alpha-olefins are 1-alkenes containing 4 to 12 carbon atoms, such as isobutylene, 1-butene, 1-hexene, 1-octene, 1-decene, and 1-dodecene, with isobutylene and 1-octene being preferred, and with 1-octene being most preferred. A part of the alpha-olefins can be replaced by one or more other monomers, e.g., up to 50 wt. % of alkyl ($C_{1-4}$) acrylates, alkyl ($C_{1-4}$) methacrylates, vinyl sulfides, N-vinyl pyrrolidone, acrylonitrile, acrylamide, as well as mixture of the same.

In accordance with the present invention, it has been unexpectedly found that compositions containing water-soluble or water-dispersible interpolymers (i.e. copolymers, terpolymers, and the like) of maleic anhydride and one or more 1-alkenes having 4 to 12 carbon atoms, particularly isobutylene and 1-octene, in combination with said sulfonated condensates, impart excellent stain-resistance to polyamide substrates (e.g. carpeting) at low pH. Compositions containing such condensates combined with copolymers of maleic anhydride with butadiene, ethylene, propylene or a 1-alkene having 14 to 24 carbon atoms were found by the inventor to be unsatisfactory for commercial purposes as stain-resists on such substrates.

A part of the maleic anhydride (up to 30 weight %) can be replaced by acrylic or methacrylic acid. In another embodiment, a pan (preferably 1–75% by weight) of the maleic anhydride can be replaced by maleimide, N-alkyl ($C_{1-4}$) maleimides, N-phenyl-maleimide, fumaric acid, itaconic acid, citraconic acid, aconitic acid, crotonic acid, cinnamic acid, alkyl ($C_{1-18}$) esters of the foregoing acids, cycloalkyl ($C_{3-8}$) esters of the foregoing acids, sulfated castor oil, or the like. At least 95 wt. % of the maleic anhydride co- or terpolymers have a number average molecular weight of in the range between about 700 and 200,000, preferably between about 1,000 and 100,000.

The maleic anhydride polymers useful in the present invention can be prepared according to methods well-known in the art. The maleic anhydride polymers thus obtained can be hydrolyzed to the free acid or their salts by reaction with water or aqueous alkali, or they can also be reacted with $C_{1-4}$ alkyl alcohol to provide polymeric alpha-olefin/maleic acid monoesters, which have stainblocking properties.

The polymers suitable for the purposes of this invention contain between about 0.4 and 1.3 polymer units derived from one or more alpha-olefin monomers per polymer unit derived from maleic anhydride. The alpha-olefin content of the polymers of this invention comprise between (a) 100 and 80 mol. % of at least one 1-alkene containing 4 to 12 carbon atoms and (b) 0 to 20 mol. % of at least one 1-alkene containing 3, or 14 to 18, carbon atoms. Polymers containing about one polymer unit derived from one or more olefin monomers per polymer unit derived from maleic anhydride are most effective in imparting stain-resistance to textile substrates. The molecular weight of the polymers useful in the invention does not appear to be a limitation so long as the polymers are water-soluble or water-dispersible. Thus, for example, hydrolyzed isobutylene/maleic anhydride copolymer having number average molecular weights between about 6,000 and 100,000 impart good stain-resistance to polyamide substrates. Even at a pH as low as 1.5, water-soluble isobutylene/maleic anhydride copolymers having number average molecular weights between about 6,000 and 100,000 remained in solution in water at 60° C.

The polymers suitable for the purposes of this invention can be prepared by hydrolyzing the maleic anhydride/olefin polymers according to methods well-known in the art. For example, they can be hydrolyzed to the free acid or their salts by reaction with water or alkali.

Suitable maleic anhydride polymers can conveniently be obtained by hydrolysis of "ISOBAM"-01, an isobutylene maleic anhydride copolymer of molecular weight around 10,000, "ISOBAM"-04 a similar polymer having a molecular weight of around 40,000 or "ISOBAM"-10 a similar polymer having a molecular weight of around 100,000 with sodium hydroxide. Other suitable maleic anhydride polymers include BM-30 available from Kuraray Co. (Japan). BM-30 is an isobutylene/maleic anhydride/N-phenylmaleimide terpolymer having a molecular weight of around 40,000. Other suitable copolymers include monoesters of $C_{4-12}$ alpha-olefin/maleic arehydride copolymers. The monoesters can be obtained by a range of reactions well known to those skilled in the art. A preferred method is by reaction with an alcohol by heating under reflux with the alcohol and then removing excess alcohol. Preferred alcohols are $C_{1-4}$ alcohols, especially methanol and ethanol.

Preparation of maleic anhydride/alpha-olefin polymers is also described in U.S. Reissue Pat. No. 28,475, in EP 306992 and by Florjanczyk et al. in J. Polymer SCI., Part A, Polymer Chem., 27 (12) pages 4099 to 4108, the disclosure of which is specifically incorporated by reference. These references contain further teaching of techniques for the preparation of such polymers.

The Sulfonated Phenol-Formaldehyde Resin

The sulfonated phenol-formaldehyde condensation products which can be used for the purposes of this invention include any sulfonated hydroxy aromatic-formaldehyde condensation products which have been described in the prior art as being useful as dye-resist agents or dye-fixing agents, in other words, dye-reserving agents or agents which improve wetfastness or dyeings on polyamide fibers. See for example U.S. Pat. No. 4,592,940, U.S. Pat. No. 4,591,591, U.S. Pat. No. 3,790,344 and GB 1,291,784, the disclosure of which is specifically incorporated herein by reference. Examples of commercially available condensation products suitable for the invention are MESITOL NBS, product of Bayer AG (a condensation product prepared from bis(4-hydroxyphenyl)-sulfone, formaldehyde, and phenol sulfonic acid, U.S. Pat. No. 3,790,344); as well as "ERIONAL" NW, a product of Ciba-Geigy Corp., (formed by condensing a mixture of naphthalene monosulfonic acid, bis(hydroxyphenyl) sulfone and formaldehyde, U.S. Pat. No. 3,716,393) and "ERIONAL"LY. The sulfonated hydroxyaromatic formaldehyde products sold as "STAINFREE" by Sybron Chemicals, "ALGARD"NS by Allied Colloid Co. and DYAPOLE SB-40 by Yorkshire Chemical Co. are also suitable.

Application

The stain-resistant composition can be effectively applied to polyamide fibrous substrates by a wide variety of methods known to those skilled in the art, such as:

padding, spraying, foaming in conjunction with foaming agents, batch exhaust in beck dyeing equipment, or continuous exhaust during a continuous dyeing operation. The stain-resist components of the present invention can be applied to the substrate separately or together as a blend. In the case of the present invention, stain-resistance of polyamide substrates is slightly better if the maleic anhydride/olefin polymer is applied to the polyamide substrate followed by the sulfonated phenol/formaldehyde condensate. On the other hand, carpet mills in general prefer to apply components of a stain-resist mixture together, and such would be expected with the composition of this invention.

The stain-resistant compositions of this invention can be applied by the foregoing methods to dyed or undyed polyamide textile substrates. In addition, they can be applied to such substrates in the absence or presence of a polyfluoroorganic oil-, water-, and/or soil-repellent materials. In the alternative, such a polyfluoroorganic material can be applied to the textile substrate before or after application of the compositions of this invention thereto.

More effective stainblocking is obtained if the stain-resistant compositions are applied to the textile substrate at either 20° C. followed by heat treatment at a temperature in the range between about 50° to 150° C. for about 1 to 60 minutes, or applied at temperatures in the range between about 40° and 95° C. for about 1 to 60 minutes. For example, at a pH between about 2 and 3, a temperature between about 70° and 90° C. is preferred. However, stain-blocking can be obtained when application is effected even at that of cold tap water (10°–15° C.).

The stain-resistant compositions of this invention can also be applied in situ to polyamide carpeting which has already been installed in a dwelling place, office or other locale. They can be applied as a simple aqueous preparation or in the form of aqueous shampoo preparation, with or without one or more polyfluoroorganic oil-, water-, and/or soil-repellent materials. They may be applied at the levels described above, at temperature described, and at a pH between about 1 and 9, preferably between about 2 and 7.

In the Examples that follow, all viscosities were determined at room temperature about 20° C. and all percentages are by weight, and the following application and testing procedures were used.

Method of Application

A light blue dyed cut-pile carpet constructed from 70 oz/sq yd SUPERBA-SET BCF nylon 66 is treated in a laboratory Beck apparatus for 20 minutes at 80° C. (176° F.) at a 20:1 liquor-to-goods ratio with a solution of a stain-resist agent described in one of the examples of pH of 2.0 and in the presence of 2.0 g per liter of magnesium sulfate to give an application load of 0.8% owf. Based on active ingredients. The carpet was then rinsed under tap water, partially dewatered by squeezing and dried in an forced-air oven for about 20 minutes at 121° C. (250° F.). A commercially available latex composition (Textile Rubber Co. Calhoun, Ga.) was applied as to carpet backing adhesive, with a secondary polypropylene backing under the trade name ACTIONBAC (AMOCO, Atlanta, Ga.).

Stain Test

A carpet specimen (3×5 inch) was placed on a flat non-absorbent surface. 20 ml of a solution made from 45 g of cherry-flavored, sugar sweetened, commercially available dilutable soft drink containing FD&C Red Dye No. 40 and 500 ml of water was poured into a 2-inch diameter cylinder which was tightly placed over the specimen. The cylinder was removed after all the liquid had been absorbed. The stained carpet specimen was left undisturbed for 24 hours, after which it was rinsed thoroughly under cold tap water and squeezed dry. The specimens were visually inspected and the amount of color remaining in the stained area rated according to the following stain rating scale:

5=no staining

4=slight staining

3=noticeable staining

2=considerable staining

1=heavy staining

In other words, a stain rating of 5 is excellent, showing outstanding stain-resistance, whereas 1 is the worst rating comparable to an untreated control sample.

Shampoo Wash Durability Test

A 3×5 inch carpet specimen was submerged for 5 minutes at room temperature in a detergent solution consisting of DUPONOL®WAQE (1.5 g per liter) and adjusted with dilute sodium carbonate to a pH of 10±0.1. The specimen was then removed, rinsed thoroughly under tap water, dewatered by squeezing and air-dried. The dry carpet specimen was then tested according to the stain test described above.

UV Lightfastness

Colorfastness to UV light was measured according to AATCC Test Method 16E-1987. The specimens were rated after exposure to 40 AATCC Fading Units (AFU) with the Gray Scale for color change.

$NO_x$ Lightfastness

Colorfastness to oxides of nitrogen was carried out according to AATCC Test Method 164-1987. At the end of 2 cycles the specimens were rated to the Gray Scale for color change.

EXAMPLE 1

To a solution of 649.5 g of sodium hydroxide in 5184 g of deionized water at 40° C. was slowly added under agitation 2,500 g of an isobutylene-maleic anhydride copolymer of 10,000 molecular weight, commercially available as "ISOBAM"-01 from Kuraray Corp., Japan. The exotherm during hydrolysis reached 70°–90° C. The reaction mass was held about 15–20 hours 80°–85° C. before cooling to 65° C. To the clear, amber solution was added under agitation 1457.5 g of a 30% sulfuric acid solution which lowered the pH to 2.65. After cooling to about 55° C., the amount of 1764.7 g of a sulfonated hydroxy-aromatic formaldehyde condensation product available from Ciba-Geigy Corp. as "ERIONAL"LY was added under agitation to give 11764.8 g of a clear, brownish solution having an active ingredient content of about 25%, a pH of 2.61 and a viscosity of 286 Pa.s. Addition of 12% sulfamic acid solution to a 1% solution of Example 1 did not cause precipitation at a pH as low as 1.5.

EXAMPLE 2

To a solution of 259.7 of sodium hydroxide in 2073.6 g of dionized water at 60° C. was slowly added under agitation 1,000 g of an isobutylene-maleic anhydride copolymer of molecular weight of about 40,000 and commercially available as "ISOBAM"-04 from Kuraray Corp., Japan. The reaction mass was agitated for 18 hours at 80°–85° C. To this clear, amber liquid was then added at 60° C. under stirring a solution of 683.3 g 30% sulfuric acid in 983.3 g deionized water to give a clear product having an active ingredient content of 20%, a viscosity of 606 Pa.s at a pH of 2.40. To 400 g of polymer prepared in the manner described above was added at room temperature and under agitation 80.0 g of a sulfonated hydroxyaromatic formaldehyde condensation product available from Ciba-Geigy Corp. as "ERIONAL"LY. The clear brownish liquid had an active ingredient content of 20.8%. A 1% solution remained clear after adjusting the pH to 1.5 with dilute sulfuric acid.

EXAMPLE 3

To a solution of 77.9 g of sodium hydroxide in 622.1 g deionized water at 40° C was slowly added 300 g of an isobutylene-maleic anhydride copolymer of 10,000 molecular weight, commercially available as "ISOBAM"-01 from Kuraray Corp., Japan. The exotherm during hydrolysis reached 70°–90° C. The reaction mass was held for about 15 to 20 hours at 80°–85° C. After cooling to 60° C. a solution of 208.6 g 30% sulfuric acid in 80 g deionized water was added under agitation to give 1288.6 g of a clear, amber solution having 23.3% of active ingredients, a pH of 2.47 and a viscosity of 340 Pa.s. To 364.8 g polymer prepared in the manner described above was added to room temperature under agitation 50 g of a sulfonated hydroxyaromatic formaldehyde condensation product available from Sybron Chemicals as "STAINFREE" (30% active ingredients) to give a clear brownish product having an active ingredient content of about 24.1%. This material remained clear when applied at a pH of 2.0 at any desired concentration.

EXAMPLE 4

To 364.8 g of the polymer used in Example 3 was added under agitation at room temperature 50 g of a sulfonated hydroxyaromatic formaldehyde condensate available from Allied Colloid Co. as "ALGARD"NS (30% active ingredients) to give a clear brownish liquid having an active ingredient content of about 24.1%. This material remained clear at a pH of 2.0 at any desired concentration.

EXAMPLE 5

To a solution of 26.0 g of sodium hydroxide in 207.4 g of deionized water was slowly added at 50° C. under stirring 100 g of an isobutylene-maleic anhydride copolymer having a molecular weight of 10,000 and commercially available as "ISOBAM"-01 from Kuraray Co., Japan. A solution of 58.8 g of a sulfonated hydroxyaromatic formaldehyde condensate available from Bayer AG. as "MESITOL"NBS (30% active ingredients) and 24.7 g of a 30% sodium hydroxide solution in 759.3 g of deionized water was added under stirring to give 1176.2 g of a clear, brownish liquid at a pH of 8.55 and an active ingredient content of 10.0%. A 1% solution remained clear after adjusting the pH to 2.0 with dilute sulfamic acid.

EXAMPLE 6

Forty grams of a copolymer of 1-octene with maleic anhydride having a number average molecular weight of 1340 by Gel Permeation Chromatography (GPC) and a composition of 1-octene to maleic anhydride of 0.53 to 1.0 by 13C NMR was hydrolyzed at 80° C. under agitation with a solution of 7.6 g sodium hydroxide in 112.4 g deionized water. The resulting clear amber solution (160g) contained 25% of active ingredients(AI).

79.2 g of the 25% AI solution of 1-octene/maleic acid was blended with 11.2 g of an alkylated($C_{12}$) disulfonated diphenyl oxide surfactant ("DOWFAX"2A4 of Dow Chemical Co.), 30.6 g of deionized water, and 16.5 g of "ERIONAL"LY (30% active ingredients), a sulfonated hydroxyaromatic formaldehyde condensation product available from Ciba-Geigy Corp. The final blend contained 18% AI consisting of 80% by weight of 1-octene/maleic acid and 20% by weight of "ERIONAL"LY.

EXAMPLE 7

Forty grams of a copolymer of 1-decene with maleic anhydride having a number average molecular weight of 1170 by GPC and a composition of 1-decene to maleic anhydride of 0.64 to 1.0 by 13C NMR was hydrolyzed at 80° C. under agitation with a solution of 6.7 g of sodium hydroxide in 153.3 g deionized water. The resulting clear amber solution (200 g) contained 20% of active ingredients.

99.0 g of the 20% solution of 1-decene/maleic acid was blended with 11.2 g of "DOWFAX"2A4 (Dow Chemical Co), 10.8 g of deionized water and 16.5 g of "ERIONAL"LY. The final blend contained 18% of active ingredients consisting of 80% by weight of 1-decene/maleic acid copolymer and 20% by weight of "ERIONAL"LY.

EXAMPLE 8

Forty grams of a terpolymer of 1-decene/1-dodecene with maleic anhydfide having a number average molecular weight of 1190 by GPC was hydrolyzed at 80° C. under agitation with a solution of 6.3 g of sodium hydroxide in 153.7 g of deionized water. The resulting clear amber solution (200 g) contained 20% of active ingredients. 99.0 g of the 20% solution of 1-decene/1-dodecene/maleic acid was blended with 11.2 g of "DOWFAX"2A4 (Dow Chemical Co.), 10.8 g of deionized water and 16.5 g of "ERIONAL"LY. The final blend contained 18% of active ingredients consisting of 80% by weight of 1-decene/1-dodecene/maleic acid terpolymer and 20% by weight of "ERIONAL"LY.

EXAMPLE 9

Forty grams of a copolymer of 1-dodecene with maleic anhydfide having a number average molecular weight of 1330 by GPC was hydrolyzed at 80° C. under agitation with a solution of 6.0 g of sodium hydroxide in 154 g of deionized water. The resulting clear amber solution(200 g) contained 20% of active ingredients.

99.0 g of the 20% solution of 1-dodecene/maleic acid was blended with 11.2 g of "DOWFAX"2A4(Dow Chemica Co.),10.8 g deionized water and 16.5 g of "ERIONAL"LY.

The final blend contained 18% of active ingredients consisting of 80% by weight of 1-dodecene/maleic acid copolymer and 20% by weight of "ERIONAL"LY.

Control A

Forty grams of a copolymer of 1-tetradecene with maleic anhydfide having a number average molecular weight of 1330 by GPC was hydrolyzed at 80° C. under agitation with a solution of 5.4 g of sodium hydroxide in 154.6 g of deionized water. The resulting clear amber solution (200 g) contained 20% of active ingredients.

99.0 g of the 20% solution of 1-tetradecene/maleic acid was blended with 11.2 g of "DOWFAX"2A4 (Dow Chemical Co.), 10.8 g of deionized water and 16.5 g of "ERIONAL"LY. The final blend contained 18% of active ingredients consisting of 80% by weight of 1-tetradecene/maleic acid copolymer and 20% by weight of "ERIONAL"LY.

Control B

Forty grams of a copolymer of 1-octadecene with maleic anhydride having a number average molecular weight of 1630 by GPC was hydrolyzed at 80° C. under agitation with a solution of 4.6 g of sodium hydroxide in 155.4 g of deionized water. The resulting clear amber solution (200 g) contained 20% of active ingredients. 99.0 g of the 20% solution of 1-octadecene/maleic acid was blended with 11.2 g of "DOWFAX"2A4 (Dow Chemical Co.), 10.8 g of deionized water and 16.5 g of "ERIONAL"LY. The final blend contained 18% of active ingredients consisting of 80% by weight of 1-octadecene/maleic acid copolymer and 20% by weight of "ERIONAL"LY.

Treatment in accordance with this invention lead to stain-resistant carpets. Whereas when applied to nylon, the compositions of Controls A & B stained badly. Furthermore, carpeting washed with shampoo after application of the stain-resists of this invention, but before staining, still possessed a high degree of stain-resistance.

I claim:

1. A polyamide fibrous substrate having deposited on it an amount of a composition effective to impart to said substrate resistance to staining by acid dyes which is durable to shampooing, and resistance to yellowing caused by exposure to UV light and/or $NO_x$ which is durable to shampooing, comprising:

(A) water-soluble or water-dispersible alpha-olefin/maleic anhydride polymers or a mixture of said polymers wherein said polymer consists essentially of between 0.4 and 1.3 polymer units derived from one or more alpha-olefin monomers per polymer unit derived from maleic anhydfide, the alpha-olefin content of said polymer comprising between (i) 100 and 80 mol percent of at least one 1-alkene containing 4 to 12 carbon atoms and (ii) 0 to 20 mol percent of at least one 1-alkene containing 3 or 14 to 18 carbon atoms, and (B) a sulfonated phenol-formaldehyde condensation product, the weight ratio of A to B being in the range between 5 to 95 and 95 to 5.

2. The substrate of claim 1 wherein said weight ratio is in the range between 90 to 10 and 10 to 90.

3. The substrate of claim 1 wherein said weight ratio is in the range between 60 to 40 and 40 to 60.

4. The substrate of claim 1 wherein at least 95 wt. % of said maleic anhydride polymers have a number average molecular weight of 700 to 200,000.

5. The substrate of claim 4 wherein at least 95 wt. % of said maleic anhydfide polymers have a number average molecular weight of 1000 to 100,000.

6. The substrate of claim 1 wherein at least one of said 1-alkenes is isobutylene.

7. The substrate of claim 1 wherein at least one of said 1-alkenes is 1-octene.

8. The substrate of either claim 1, 2, 3, 4, 5, 6 or 7 wherein said polymer contains one polymer unit derived from maleic anhydride per polymer unit derived from one or more of said 1-alkene monomers.

9. The substrate of claim 1 wherein up to 50 weight % of said alpha-olefin is replaced by one or more of $C_1$ to $C_4$ alkyl acrylate or methacrylate, vinyl acetate, vinyl chloride, vinylidene chloride, vinyl sulfide, N-vinyl pyrrolidone, acrylonitrile, or acrylamide, or mixtures of the same.

10. The substrate of claim 1 wherein up to 75 weight % of said maleic anhydride is replaced by maleimide, N-alkyl ($C_{1-4}$) maleimides, N-phenylmaleimide, fumaric acid, iraconic acid, citraconic acid, aconitic acid, crotonic acid, cinnamic acid, alkyl ($C_{1-18}$) or cycloalkyl ($C_{3-8}$) esters of the foregoing acids or sulfated castor oil.

11. The substrate of claim 1 wherein up to 30 weight % of the maleic anhydride is replaced by acrylic or methacrylic acid.

12. The substrate of claim 1 wherein said alpha-olefin/maleic anhydride polymer or mixture thereof is hydrolyzed to the free acid or salts thereof by reaction with water or aqueous alkali.

13. The substrate of claim 1 wherein said alpha-olefin/maleic anhydride polymer or mixture thereof is reacted with an alkyl alcohol containing 1 to 4 carbon atoms to give polymeric alpha-olefin/maleic acid monoesters.

* * * * *